US008464482B2

(12) United States Patent
Raynor

(10) Patent No.: US 8,464,482 B2
(45) Date of Patent: Jun. 18, 2013

(54) SECTIONED PRECAST DECK FOOTINGS/ PIERS

(76) Inventor: Brice C. Raynor, Harrisville, NH (US)

( * ) Notice: Subject to any disclaimer, the term of this patent is extended or adjusted under 35 U.S.C. 154(b) by 164 days.

(21) Appl. No.: 12/804,952

(22) Filed: Aug. 2, 2010

(65) Prior Publication Data

US 2011/0030299 A1 Feb. 10, 2011

Related U.S. Application Data

(60) Provisional application No. 61/213,975, filed on Aug. 4, 2009.

(51) Int. Cl.
*E02D 27/00* (2006.01)

(52) U.S. Cl.
USPC ..... 52/296; 52/223.5; 52/293.2; 52/849; 52/169.9; 52/592.6

(58) Field of Classification Search
USPC ..... 52/292, 293.2, 295, 296, 297, 298, 52/169.9, 592.6, 223.5, 600, 604, 122.1, 52/124.2, 848, 849, 606; 405/231, 251, 252, 405/256; 14/77.1, 73.5, 74.5, 77.3, 78, 75
See application file for complete search history.

(56) References Cited

U.S. PATENT DOCUMENTS

| | | | | | |
|---|---|---|---|---|---|
| 222,211 | A * | 12/1879 | Thompson | 138/115 |
| 762,496 | A * | 6/1904 | Smith | 405/222 |
| 1,020,645 | A * | 3/1912 | Hall | 52/585.1 |
| 1,647,925 | A * | 11/1927 | May | 52/223.5 |
| 1,723,216 | A * | 8/1929 | Stam | 52/223.5 |
| 1,746,672 | A * | 2/1930 | Nylund et al. | 52/223.5 |
| 1,907,170 | A * | 5/1933 | A Hearn | 165/9.1 |
| 2,374,624 | A * | 4/1945 | Schwendt | 52/223.5 |
| 2,664,739 | A * | 1/1954 | Marcy | 52/474 |
| 3,545,214 | A * | 12/1970 | Grazel | 405/252 |
| 3,899,891 | A * | 8/1975 | Kelly et al. | 405/251 |
| 4,239,419 | A * | 12/1980 | Gillen, Jr. | 405/232 |
| 4,297,816 | A * | 11/1981 | Kella et al. | 52/125.3 |
| 4,627,769 | A * | 12/1986 | Lee | 405/256 |
| 4,726,567 | A * | 2/1988 | Greenberg | 256/19 |
| 4,735,527 | A * | 4/1988 | Bullivant | 405/232 |
| 4,757,656 | A * | 7/1988 | Powers, Jr. | 52/204.2 |
| 4,918,891 | A * | 4/1990 | Gerszewski | 52/295 |
| 4,953,332 | A * | 9/1990 | Galloway | 52/223.5 |
| 5,007,218 | A * | 4/1991 | Bengtson et al. | 52/204.2 |
| 5,379,563 | A * | 1/1995 | Tinsley | 52/295 |
| 5,398,477 | A * | 3/1995 | Philipp et al. | 52/848 |
| 5,787,675 | A * | 8/1998 | Futagi | 52/745.1 |
| 5,934,035 | A * | 8/1999 | Rasmussen et al. | 52/300 |
| 6,015,138 | A * | 1/2000 | Kohlberger et al. | 256/65.14 |
| 6,088,987 | A * | 7/2000 | Simmons et al. | 52/592.6 |
| 6,098,357 | A * | 8/2000 | Franklin et al. | 52/223.7 |
| 6,178,714 | B1 * | 1/2001 | Carney, Jr. | 52/564 |
| 6,185,888 | B1 * | 2/2001 | Wasson | 52/300 |
| 6,244,009 | B1 * | 6/2001 | Cerrato | 52/604 |
| 6,571,521 | B1 * | 6/2003 | Ameigh | 52/295 |

(Continued)

*Primary Examiner* — Robert Canfield
*Assistant Examiner* — Matthew Gitlin
(74) *Attorney, Agent, or Firm* — Davis & Bujold, PLLC

(57) ABSTRACT

An assembly of precast concrete units matingly assembled on top of one another to form a whole deck footing, capable of supporting a deck, shed, porch, addition or other structure. The individual units are of manageable weight and can be moved by one person, not unlike a bag of unmixed cement. The units interlock to prevent shifting, separating, frost damage by water infiltration and heaving when placed under ground.

18 Claims, 6 Drawing Sheets

U.S. PATENT DOCUMENTS

| | | | | |
|---|---|---|---|---|
| 6,685,399 | B2 * | 2/2004 | Iemura et al. | 405/256 |
| 6,742,211 | B2 * | 6/2004 | Copher et al. | 14/75 |
| 6,745,529 | B2 * | 6/2004 | Beltran | 52/297 |
| 6,758,020 | B2 * | 7/2004 | Cerrato | 52/606 |
| 7,302,778 | B2 * | 12/2007 | MacMillan | 52/169.9 |
| 7,305,803 | B2 * | 12/2007 | Correa et al. | 52/604 |
| 7,387,472 | B2 * | 6/2008 | Abella | 405/284 |
| 7,546,712 | B2 * | 6/2009 | Shaw | 52/223.8 |
| 7,641,178 | B2 * | 1/2010 | MacDonald et al. | 256/19 |
| 8,225,578 | B2 * | 7/2012 | Azizi Ronagh | 52/747.1 |
| 8,341,788 | B2 * | 1/2013 | Kim et al. | 14/77.3 |
| 2001/0000370 | A1 * | 4/2001 | Traxler | 52/169.14 |
| 2004/0020155 | A1 * | 2/2004 | Correa et al. | 52/604 |
| 2004/0141814 | A1 * | 7/2004 | Covington | 405/230 |
| 2005/0086881 | A1 * | 4/2005 | Greenberg et al. | 52/292 |
| 2005/0257481 | A1 * | 11/2005 | Shaw | 52/606 |
| 2006/0201082 | A1 * | 9/2006 | Hammer et al. | 52/223.5 |
| 2007/0056235 | A1 * | 3/2007 | Kohler | 52/223.7 |
| 2007/0271868 | A1 * | 11/2007 | Abella | 52/600 |
| 2008/0256894 | A1 * | 10/2008 | Marsh et al. | 52/719 |

* cited by examiner

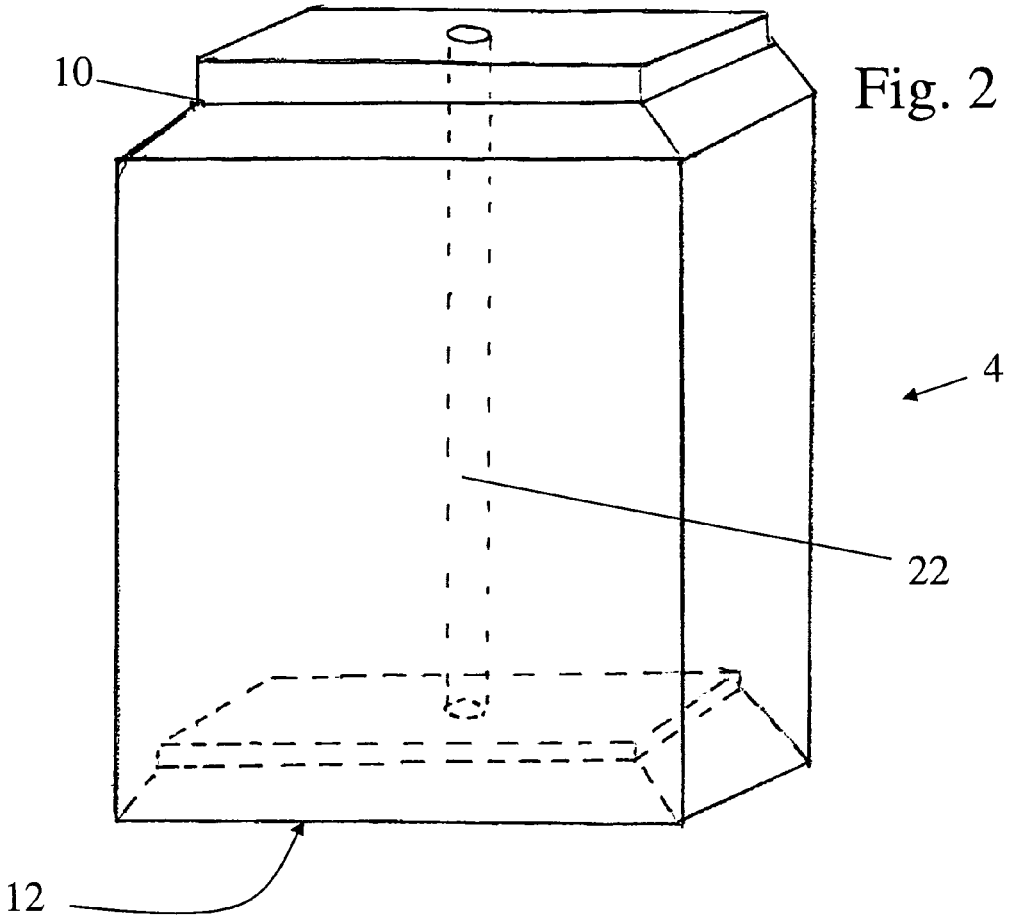
Fig. 2
Fig. 3
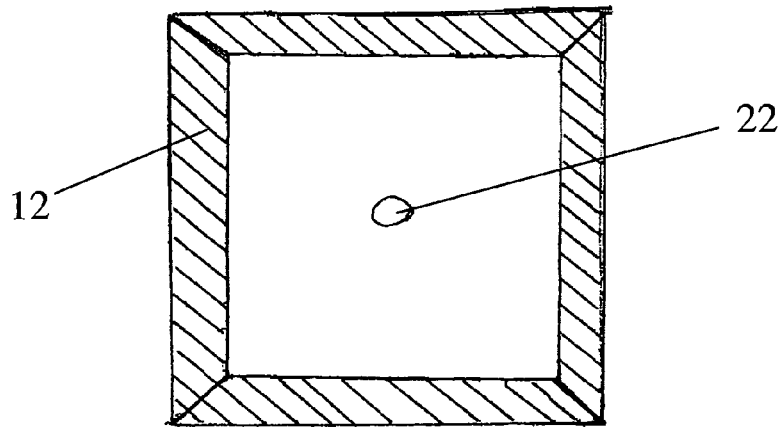

SECTIONED PRECAST DECK FOOTINGS/ PIERS

CROSS REFERENCE TO RELATED APPLICATIONS

This application claims priority under 35 U.S.C. §119(e) to U.S. Provisional Patent Application Ser. No. 61/213,975, filed Aug. 4, 2009, which priority application is herein incorporated by reference in its entirety.

FIELD OF THE INVENTION

The present invention relates to an assembly of precast concrete units, mateingly assembled on top of one another to form a whole deck footing for supporting structures.

BACKGROUND OF THE INVENTION

Currently several techniques for creating deck footings exist. One type is to excavate the ground, place a round cardboard tube in the hole, level the tube and back fill around the tube. The tube is then filled with concrete and let it cure for an amount of time. The cardboard tubes that are currently in use are susceptible to rain and can warp when dirt is backfilled around the tube. Another type of footing currently in use is a solid precast pier. It can weigh 450 pounds or more and requires the use of heavy equipment to move.

SUMMARY OF THE INVENTION

Wherefore, it is an object of the present invention to overcome the above mentioned shortcomings and drawbacks associated with the prior art.

Another object of the present invention is to eliminates the need for placement of cardboard tubes or other means of forming deck footings or pilings for structure support. This invention is a simpler and more earth friendly approach. It eliminates the need for mixing quantities of concrete to fill said forms and eliminates the need to wait for the concrete to set up. Because the individual precast units in this invention are of manageable weight no equipment is necessary to place the footings, the cost is reduced and almost anyone is capable of placing these footings. This invention will be easier to level than the current technology because the footing unit can be placed and leveled before the upper stacking units are added, as opposed to the current technology that requires placing and leveling an entire 450 pound unit. This invention is also superior to a cardboard tube, as, unlike cardboard tubes, this invention is not susceptible to damage caused by rain and will also remain level when back filled. The quality of the invention is precast footings will be more manageable, and thus ensure a better end product than a pour in place cardboard tube. This invention also solves the problem of storage for retailers. This invention can be exposed to the elements without damage, where as damage results when cardboard tubes or bags of concrete mix are left in the elements.

The present invention also relates to an assembly for supporting structural weight comprising, at least two stacking units substantially identical in shape, wherein an upper portion of an at least one first stacking unit fits securely into a recess defined in the lower portion of an at least one second stacking unit and securing means for securing the at least one first stacking unit to the at least one second stacking unit.

BRIEF DESCRIPTION OF THE DRAWINGS

FIG. 2 is a drawing of a stacking unit.

FIG. 3 is a bottom view of a stacking unit.

DETAILED DESCRIPTION OF THE INVENTION

Figure 1:
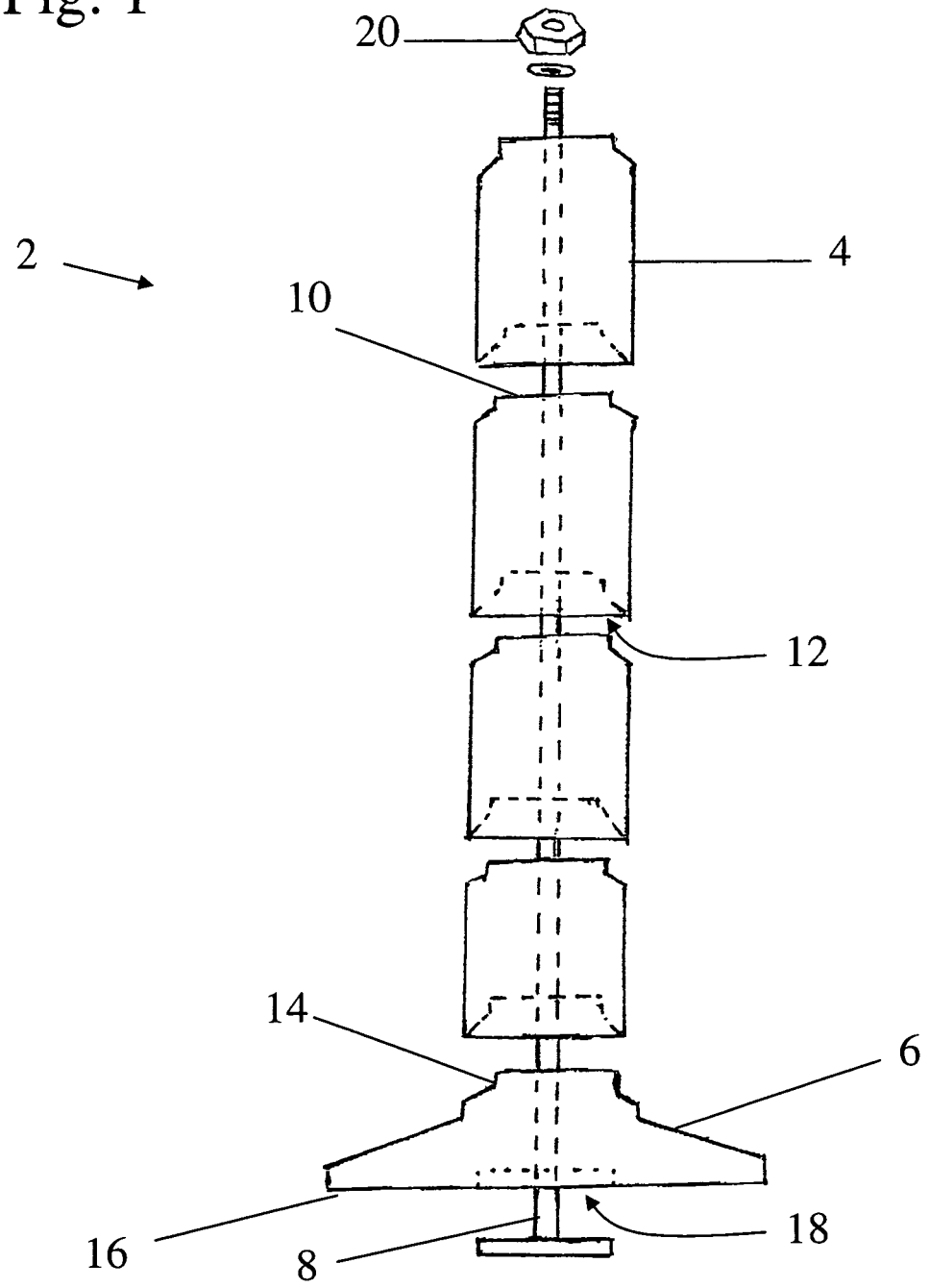
FIG. 1 is an exploded depiction of the assembled unit.

With reference now to FIGS. 1-8, a detailed description concerning the assembly 2 of the present invention will now be provided. As can be seen in FIG. 1, for example, the assembly 2 is generally comprised of a plurality of stacking units 4, a footing unit 6, and an anchor 8.

The stacking units 4 are substantially identical in size and shape and each stacking unit 4 has an upper portion 10 that matingly fits into a recess 12 in the lower portion of another stacking unit 4. This mating fit speeds assembly by automatically aligning one stacking unit 4 to another, and adds structural integrity to the assembled assembly 2 by providing resistance to lateral movement of the stacking units. Generally, the top of the upper portion 10 of the stacking unit 4 is flat to accommodate a support beam for a structure, but this is not necessary. The sides of upper portion 10 may be either vertical or diagonal or, as shown in FIGS. 1 and 2, both vertical and diagonal.

The outer perimeter of the stacking units 4 can be a variety of shapes and still function in the inventive capacity. Contemplated shapes of the stacking units 4 are circular, square, elliptical, rectangular, triangular, or hexagonal, and other bilaterally symmetric shapes. It is to be noted that the stacking units 4 need not be of a bilaterally symmetric shape to still function in the inventive capacity. Additionally, the units could interlock in a variety of ways, including a tapered top sleeving into a receiving bottom.

The footing unit 6 has a flat base 16 that is wider than the base of the staking units 4 and has an upper portion 14 that is sized to also fit matingly into the recess 12 in the lower portion of a stacking unit 4. The base 16 of the footing unit 6 may have a similar or different shape as the stacking unit 4. The sides of the footing unit 6 slope to allow water to run off the footing unit 6, as it is wider than the stacking units 4 and is a potential trap for water. While it is generally preferred to use the footing unit 6 in the assembly 2, the assembly 2 may be assembled with only a plurality of stacking units 4 and an interlocking means and still possess the inventive aspect of the present invention. The diameter of the stacking units 4 and the footing unit 6 may vary to accommodate the residential or construction use.

Figure 6:
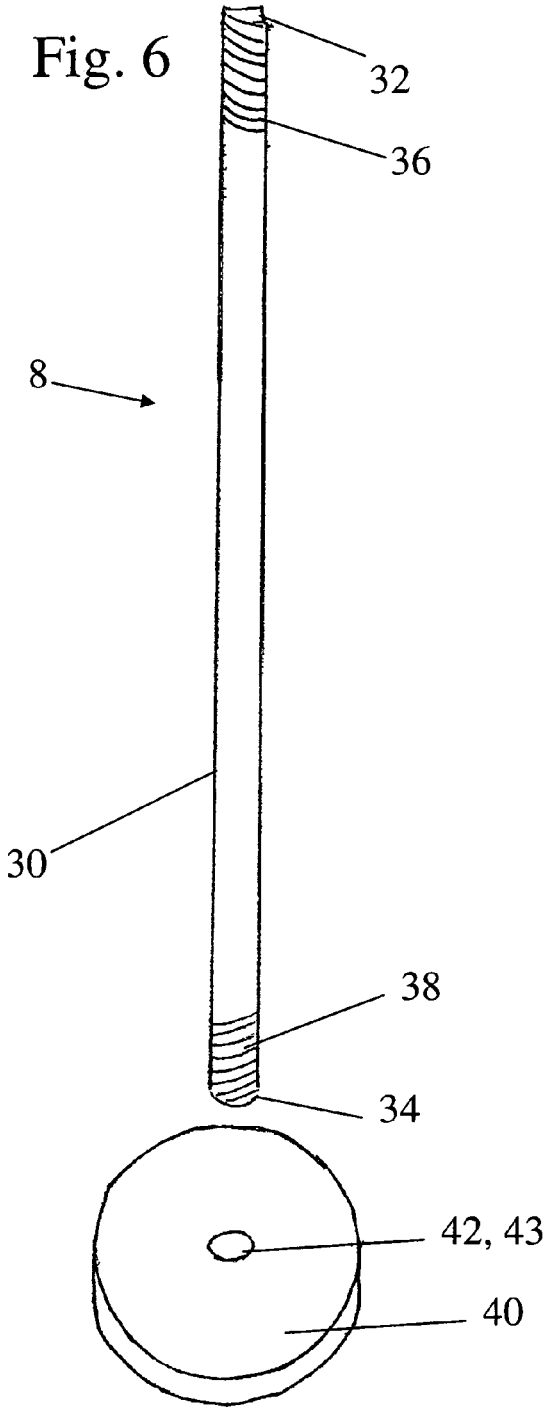
FIG. 6 is a drawing of an anchor.
Figure 7:
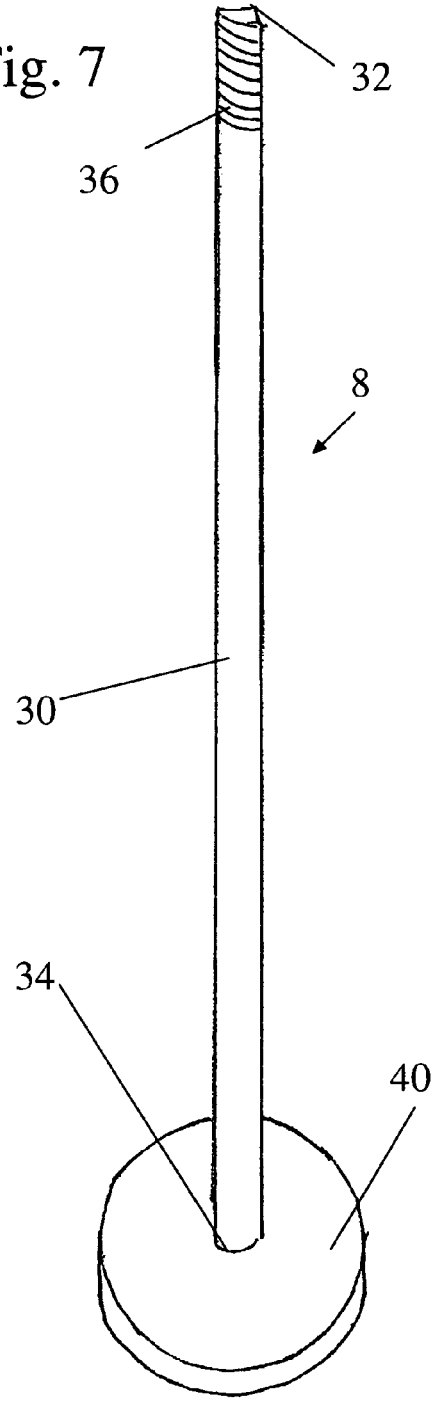
FIG. 7 is a drawing of an anchor.

Turning to FIGS. 6 and 7, the anchor 8 is comprised of a rod 30, with a first end 32 and a second end 34. The first end 30 has a first threaded section 36, and depending on the embodiment, the second end 34 may have a second threaded section 38. The rod 30 is sized to fit within an axial through channel 22 that runs through the stacking units 4 and base unit 6. The rod 30 is of a sufficient length such that when the assembly 2 is assembled, the rod 30 reaches from base 16 of the footing unit 6 to above the upper portion 10 of the top most stacking unit 4. An alternate embodiment, not show, has the rod 30 threaded completely from the first end 32 to the second end 34.

The function of the anchor 8 is to vertically fix and provide compression force on the assembled units and to provide added lateral support to prevent the units from shifting. This is achieved by first passing the rod 30 through the axial through channel 22 of the assembled units, then securing the first end 32 of the rod 30 above the top of upper portion 10 of the top most stacking unit 4, and then securing the second end 34 of the rod 30 below the base 16 of the footing unit 6. The first end 32 of the rod 30 is generally secured by screwing an appropriately sized washer and nut 20 onto the first threaded section 36 of the first end 32 of the rod 30 which protrudes above the upper portion 10 of the top most stacking unit 4. It is to be noted that the various methods to secure the second end 34 of the rod 30, listed below, may also be used to secure the first end.

The second end 34 of the rod 30 may be secured by a variety of methods, some described below. In one embodiment, the second end 34 of the rod 30 is pre-welded to a flat metal plate 40. In another group of embodiments, the second end 34 of the rod 30 has a second threaded section 38. This second threaded section 38 may be secured by screwing an appropriately sized washer and nut 20 onto the second threaded section 36 that extends out of the lower opening of the axial through channel 22 of the lower most unit. In another embodiment, the nut 20 could be precast into the axial through channel 22 of the footing unit 6, and then the rod 8 would be screwed into the footing unit 6.

Additionally, a flat metal plate 40 with a through hole 42 may be used in conjunction with an appropriately sized washer and nut 20, mounting the metal plate 40 onto second end 34 of the rod 30, and then screwing the nut 20 onto the second threaded end 36 of the rod 30. This metal plate may be in any shape, though, because of ease of production, circular and square/rectangular shapes are preferred. In a variation of this embodiment, the nut 20 is pre-welded onto the metal plate 40, aligned with and underneath the through hole 42 in the metal plate 40. In another embodiment, the flat metal plate 40 has a threaded hole 43, appropriately sized to fit the second threaded section of the second end of the rod, and the flat metal plate 40 would screw directly onto the rod 30. In a variation of this embodiment, the nut 20 is pre-welded onto the metal plate 40, aligned with and underneath the threaded hole 43 in the metal plate 40.

With the embodiments that utilize a flat metal plate, a central portion of the base 16 of the footing unit 6 generally will have a recess 18 sized so that that the flat metal plate 40 fits securely within the recess 18. This allows the anchor 8 to more securely attach to the units. Additionally with the embodiments that utilize a flat metal plate 40, the recess 12 in the lower portion of the stacking unit 4 will be sized so that that the flat metal plate 40 fits securely within the recess 12. This preserves the option of using a flat metal plated 40 anchor 8 in an assembly 2, without also requiring the use of a footing member 6.

Figure 8:
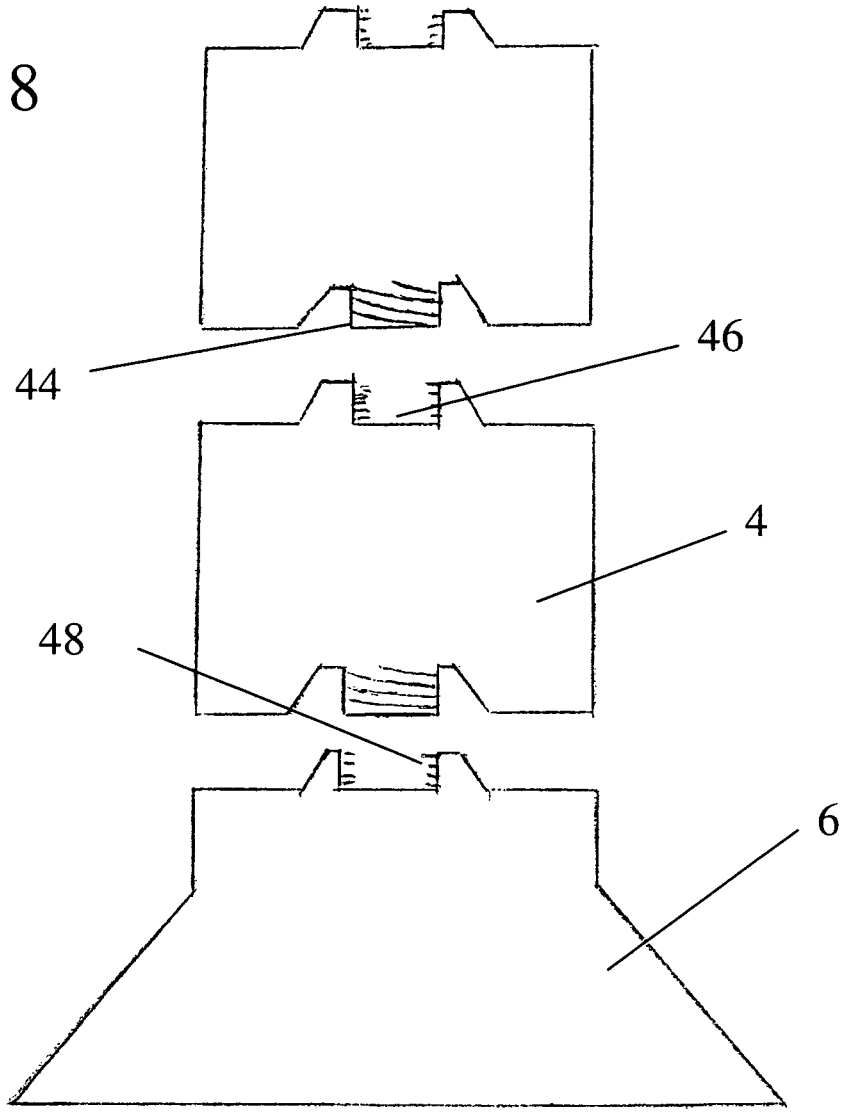
FIG. 8 is a drawing of the stacking and footing units with precast threaded inserts.

As an alternative to using an anchor for securing the units together, in other embodiments the units are designed to fixedly screw one to another. One embodiment of this design is shown in FIG. 8, where a male threaded insert 44 is cast into the bottom of the stacking unit 4. Additionally, a female threaded insert 46 is cast into the upper portion 10 of the stacking unit and a female threaded insert 48 is cast into the upper portion 14 the footing unit 6. The male threaded insert 44 and the female threaded inserts 46,48 are sized to fit matingly together, such that when a stacking unit is placed on top of a footing unit or another stacking unit and rotated, one unit will screw into another until the two units are securely attached. The threaded inserts 44, 46, 48 can be threaded cups constructed of metal and/or plastic.

Figure 4:
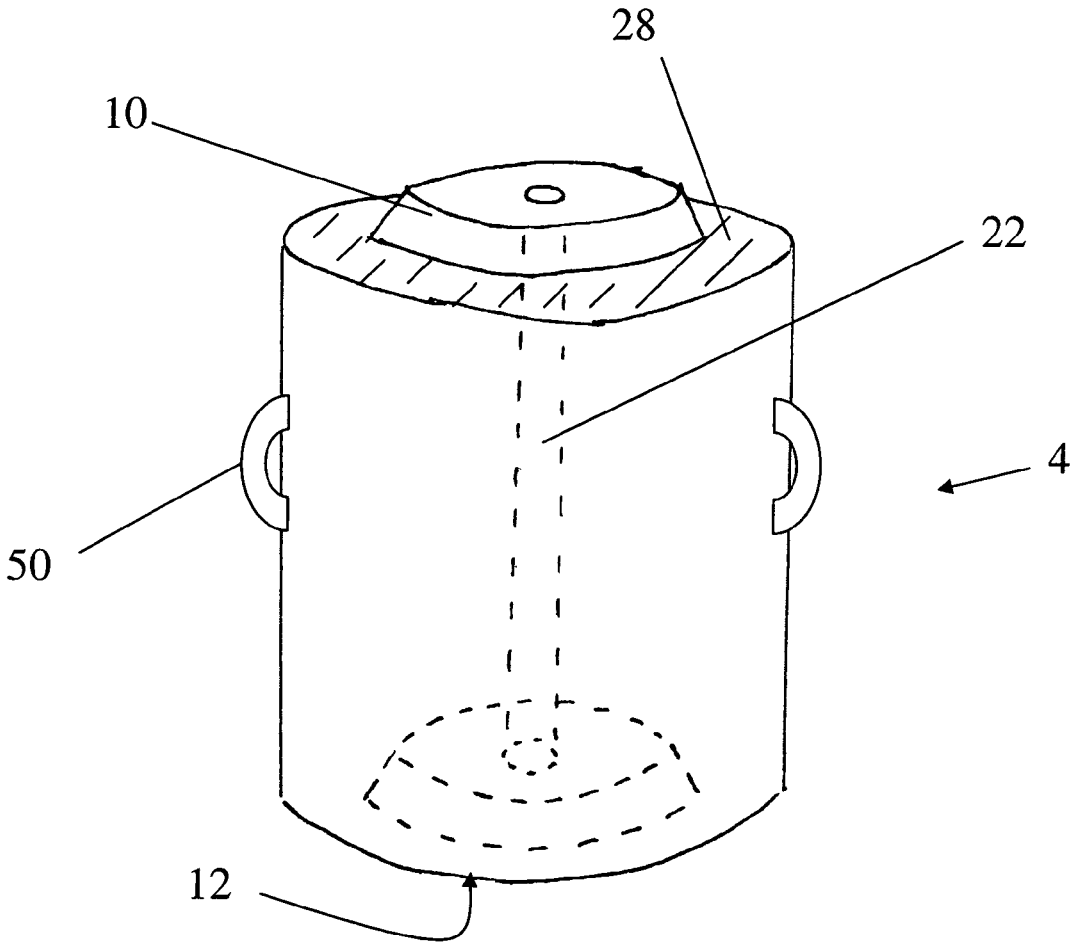
FIG. 4 is a drawing of a stacking unit.
Figure 5:
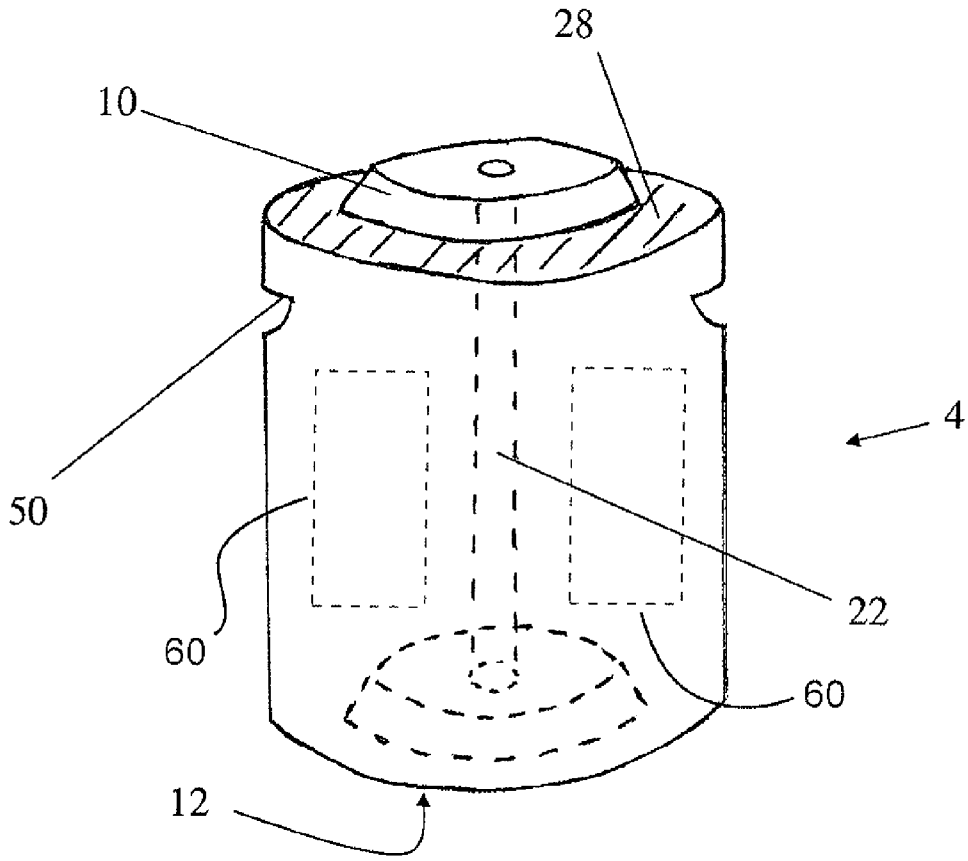
FIG. 5 is a drawing of a stacking unit.

The stacking units 4 and footing units 6 are generally formed of precast concrete, but may be built of other materials that provide sufficient structural strength, such as wood composites, plastics, metals, and flyash. The stacking units 4 and footing units 6 are sized to be maneuverable by an adult man of average strength, with each stacking unit 4 being generally between 20 and 90 pounds and preferably between 50 and 80 pounds in weight, and each footing unit 6 being generally between 30 and 140 pounds, and preferably between 70 and 120 pounds in weight. As shown in FIG. 4, and the preferred embodiment of FIG. 5, to increase maneuverability the stacking units 4 and the footing units 6 may include a variety of precast handles 50. Generally units formed from concrete will contain integrated metal structural support 60 in the form of wire mesh, galvanized pipe or rebar cage precast into the units.

Though the tight fitting arrangement of the assembly 2 acts to prevent water from coming between the units, the stacking units 4 and footing units 6 may further include a water barrier 28 between the units. The water barrier 28 may be in the form of a water proofing membrane fixedly attached to some or all of the outer surface of the units, which will act to stop water infiltration between each of the units. The membrane can act as a seal when the units are placed together and compression force is applied. It is contemplated that one possible use for the assembly 2 will require it to be at least partially below ground, and the water barrier 28 will help prevent ground water from seeping between the below ground units.

To use the assembly 2, the necessary size of the assembly 2 must be determined, including any height and diameter requirements or restrictions. Generally, for each column or deck footing required, a contractor will procure the appropriate size and number of stacking units 4 and footing units 6 so that once assembled, the assembly 2 will be of correct height for the deck footing or other structural requirement. Next, the contractor will procure one threaded flat metal plate 40, one nut 20, one washer, and one rod 30 for each assembly to be assembled, the rod 30 sized to be a few inches longer that the height of the assembled assembly 2. The contractor will dig an appropriately sized hole, and place and level the footing unit 6 in the hole, with the rod 30 and the attached flat metal plate 40, and sleeved through the axial through channel 22 of the footing unit 6. Next, the contractor will add additional stacking units 4 until the desired height is reached. Finally, the contractor will place the washer and nut 20 onto the first threaded section 36 of the first end 32 of the rod 30, and screw the nut 20 down until the sufficient compression force is applied.

What is claimed is:

1. A deck pier footing for supporting structural weight comprising, at least two concrete stacking units substantially identical in shape, wherein an upper portion of an at least one first stacking unit fits securely into a recess defined in a lower portion of an at least one second stacking unit;

only one through channel extending in each stacking unit, the through channel extending through a central axis of each stacking unit;

a planar circular upper surface of the upper portion being perpendicular to and radiating horizontally outwardly from the through channel;

a planar circular horizontal surface of each recess being directly adjacent to the planar circular upper surface of the upper portion of a next lower stacking unit;

a securing element, which secures the at least one first stacking unit to the at least one second stacking unit, comprising a single metal rod extending through and substantially completely filling the axial through channel from the upper surface of a vertically highest stacking unit to a lower surface of a vertically lowest stacking unit.

2. The deck pier footing of claim 1 wherein the securing element applying a compressive force directly to both a vertically highest stacking unit and a vertically lowest stacking unit;

a cross section, perpendicular to the through channel, of a radially outer surface of each stacking unit being circular in shape;

a complete perimeter of the radially outer surface of each stacking unit spaced from any horizontally adjacent other stacking unit;

the vertically lowest stacking unit is a footing unit comprising a base which is wider than a base of each stacking unit stacked vertically above the footing unit, an upper portion of the footing unit fits matingly into the recess in the lower portion of each stacking unit; and the planar circular upper surface of the upper portion being at least one half the diameter of the perimeter of the radially outer surface of each non-footing stacking unit.

3. The deck pier footing of claim 2 wherein the securing element is an anchor comprising the rod having a first threaded section on a first axial end.

4. The deck pier footing of claim 3 further comprising;

a flat metal plate attached to an opposite second axial end of the rod;

a recess defined in a central portion of the base of the footing unit such that the flat metal plate fits securely within the recess.

5. The deck pier footing of claim 4 wherein the flat metal plate is sized to fit securely within the recess in the lower portion of the stacking unit.

6. The deck pier footing of claim 3 further comprising;

a second threaded section on the second end of the rod; and a nut, fixedly attached to the base of the footing unit such that the second threaded section on the second end of the rod fasteningly screws into the nut.

7. The deck pier footing of claim 3 further comprising;

a second threaded section on the second end of the rod;

a flat metal plate having a hole;

the hole being a threaded hole sized to fasteningly screw onto the second threaded section of the second end of the rod; and a recess defined in a central portion of the base of the footing such that the flat metal plate fits securely within the recess.

8. The deck pier footing of claim 3 further comprising;

a second threaded section on the second end of the rod;

a flat metal plate, having a hole;

the hole being a through hole sized to allow passage of the second end of the rod;

a recess defined in a central portion of the base of the footing unit such that the flat metal plate fits securely within the recess; and a nut, having an internal threaded hole sized to fasteningly screw into the second threaded section of the second end of the rod.

9. The deck pier footing of claim 8 wherein the first threaded section and the second threaded section are of sufficient size such that they contiguously meet in the middle of the length of the rod, whereby the rod is effectively continuously threaded from the first end of the rod to the second end of the rod.

10. The deck pier footing of claim 3 wherein the stacking units and the base units are substantially comprised of precast concrete.

11. The deck pier footing of claim 10 wherein the concrete includes integrated metal structural support.

12. The deck pier footing of claim 10 further including a water barrier between the units such that ground water is prevented from seeping between the units under ground.

13. The deck pier footing of claim 10 wherein the cross sectional width of the stacking unit at its greatest cross sectional width is between six inches and fifteen inches.

14. The deck pier footing of claim 10 wherein the weight of the individual stacking unit is between 50 pounds and 90 pounds so that the individual units may be carried by an average adult man.

15. The deck pier footing of claim 14 wherein the stacking units include at least two recessed handles disposed in the radially outer surface to facilitate a person carrying or moving the units.

16. The deck pier footing of claim 10 wherein the weight of the individual stacking unit is substantially 80 pounds so that the individual units may be carried by an average adult man.

17. The deck pier footing of claim 10 wherein all units of the pier footing are coaxial and the through channel is of substantially constant radius.

18. A concrete pier footing for supporting structural weight comprising, at least two stacking units substantially identical in shape, wherein an upper portion of at least one first stacking unit fits securely into a recess defined in a lower portion of at least one second stacking unit;

a footing unit wherein a base of the footing unit is wider than a base of each stacking unit and an upper portion of the footing unit matingly fits into a recess in the lower portion of the first stacking unit, only one through channel extending in each stacking and footing units, the through channel extending through a central axis of each stacking and footing units;

a planar circular upper surface of the upper portion being perpendicular to and radiating horizontally outwardly from the through channel;

a planar circular horizontal surface of each recess being directly adjacent to the planar circular upper surface of the upper portion of a next lower stacking unit;

a single continuous anchor rod with a first threaded section on a first end and a second threaded section on a second end, the rod sized to fit within and substantially completely fill the through channel in the stacking units and the footing unit, and of a length that when the pier footing is assembled, the rod reaches from base of the footing unit to above the upper portion of a top most stacking unit;

a flat metal plate having a threaded hole sized to fastentingly screw onto the second threaded section on the second end of the rod;

a recess defined in a central portion of the base of the footing unit such that the flat metal plate may fit securely within such recess;

the stacking and footing units being substantially comprised of precast concrete;

the precast concrete having integrated metal structural support;

a water barrier between the units such that ground water is prevented from seeping between the units and under ground;

the stacking units having an individual weight of between 20 pounds and 90 pounds; the footing units having an individual weight of between 30 pounds and 140 pounds; and the outer perimeter of a cross section of the stacking unit forming a bilaterally symmetric shape; and each stacking unit, the footing unit, the through channel, and the anchor rod of the pier footing are coaxial and vertically aligned.

* * * * *